US006941998B2

(12) United States Patent
Nien

(10) Patent No.: US 6,941,998 B2
(45) Date of Patent: Sep. 13, 2005

(54) VENETIAN BLIND STRUCTURE

(76) Inventor: Leslie Nien, No. 45-4, Fan Po St., Fu Hsing Hsiang, Changhua Hsien (TW)

( * ) Notice: Subject to any disclaimer, the term of this patent is extended or adjusted under 35 U.S.C. 154(b) by 0 days.

(21) Appl. No.: 10/778,396

(22) Filed: Feb. 17, 2004

(65) Prior Publication Data

US 2005/0098274 A1 May 12, 2005

(30) Foreign Application Priority Data

Nov. 7, 2003 (TW) ..... 92219821 U

(51) Int. Cl.[7] ..... E06B 9/303
(52) U.S. Cl. ..... 160/168.1 R
(58) Field of Search ..... 160/168.1 R, 173 R, 160/172 R, 176.1 R, 177 R, 178.1 R, 170 R, 171 R

(56) References Cited

U.S. PATENT DOCUMENTS 1,949,653 A * 3/1934 Moore ..... 160/170
2,837,152 A * 6/1958 Moore, Jr. ..... 160/168.1 R
4,567,930 A * 2/1986 Fischer ..... 160/166.1
4,699,196 A * 10/1987 Elliott ..... 160/168.1 R
4,742,860 A * 5/1988 Debs ..... 160/178.1 V
4,791,703 A * 12/1988 Chang ..... 16/94 D

* cited by examiner

*Primary Examiner*—David Purol
(74) *Attorney, Agent, or Firm*—Troxell Law Office, PLLC

(57) ABSTRACT

A Venetian blind structure includes an upper and lower beams made up of telescopically adjustable upper and lower inner/outer brackets respectively wherein a plurality of pull cord and retaining cord mounts are equidistantly adapted at the upper inner/outer brackets therein for a pair of mutually engaged internal and external rods to be mounted thereon, and the internal and external rods thereof have a plurality of adjustment blocks sequentially joined thereto for holding both ends of U-shaped retaining cords thereby. The mutually engaged lower inner/outer brackets are located at the bottommost side of the retaining cords therein, and plural pairs of mutually abutted upper inner and lower outer blind slats are located at retaining holes defined by upper/lower clamping sections distributed equidistantly from top to bottom of the retaining cords thereof. Thus, due to the sleeve engagement of the upper and lower inner/outer brackets and the abutting location of the upper inner and lower outer blind slats thereof, the upper inner bracket and blind slats, and the lower inner bracket thereof can be simultaneously pushed towards the upper outer upper bracket, and the lower outer blind slats and bracket thereof respectively to telescopically adjust and shorten the overall length of the blind thereof, widely fitting to windows of different sizes as well as efficiently cutting down the packing materials required for more economical use of the shipping space to increase the quantity of shipment and the convenience of delivery thereof.

6 Claims, 4 Drawing Sheets

VENETIAN BLIND STRUCTURE

BACKGROUND OF THE INVENTION

The present invention is related to a Venetian blind structure, including an upper and lower beams made up of telescopically adjustable upper and lower inner/outer brackets respectively, and plural pairs of mutually abutted upper inner and lower outer blind slats located at retaining holes defined by upper/lower clamping sections distributed equidistantly from top to bottom of U-shaped retaining cords; whereby, due to the sleeve engagement of the upper and lower inner/outer brackets and the abutment location of the upper inner and lower outer blind slats thereof, the upper inner bracket and blind slats, and the lower inner bracket thereof can be simultaneously pushed towards the upper outer upper bracket, and the lower outer blind slats and bracket thereof respectively to telescopically adjust and shorten the overall length of the blind thereof, widely fitting to windows of different sizes as well as efficiently cutting down the packing materials required for more economical use of the shipping space so as to increase the quantity of shipment and the convenience of delivery thereof.

A conventional blind structure is made up of an upper and lower beams, and a blind embodiment attached to the underside of the upper beam wherein the upper and lower beams and the blind embodiment are integrally molded into a certain length and size, which is rather inconvenient for taking too much space in delivery as well as uneconomical for wasting time and materials in package. Even if the upper and lower beams thereof are capable of telescopically adjusted in length, the blind slats, though, are integrally molded into a fixed length without any adjustable functions, uneconomically wasting packing materials and occupying shipping space so that the quantity of shipment thereof is greatly reduced.

SUMMARY OF THE PRESENT INVENTION

It is, therefore, the primary purpose of the present invention to provide a Venetian blind structure, including an upper and lower beams made up of telescopically adjusted upper and lower inner/outer brackets respectively, and plural pairs of upper inner and lower outer blind slats located at retaining holes defined by upper/lower clamping sections distributed equidistantly from top to bottom of U-shaped retaining cords; whereby, via the sleeve engagement of the upper and lower inner/outer brackets thereof respectively and the abutting location of the upper inner and lower outer blind slats thereof, the upper inner bracket and blind slats, and the lower inner bracket thereof can be simultaneously pushed towards the upper outer bracket, and the lower outer blind slats and bracket thereof respectively to telescopically shorten the overall length of the Venetian blind thereof, efficiently cutting down the packing materials required for more economical use of the shipping space to increase the quantity of shipment and the convenience of delivery thereof.

It is, therefore, the second purpose of the present invention to provide a Venetian blind structure wherein the upper inner/outer brackets with an internal and external rods adapted therein, and the lower inner/outer brackets as well as the upper inner and lower outer blind slats thereof can be telescopically adjusted in length to widely fit to windows of different sizes without any other cutting tools required, facilitating the widespread use and the convenience of the present invention thereof.

DETAILED DESCRIPTION OF THE PREFERRED EMBODIMENTS

Figure 1:
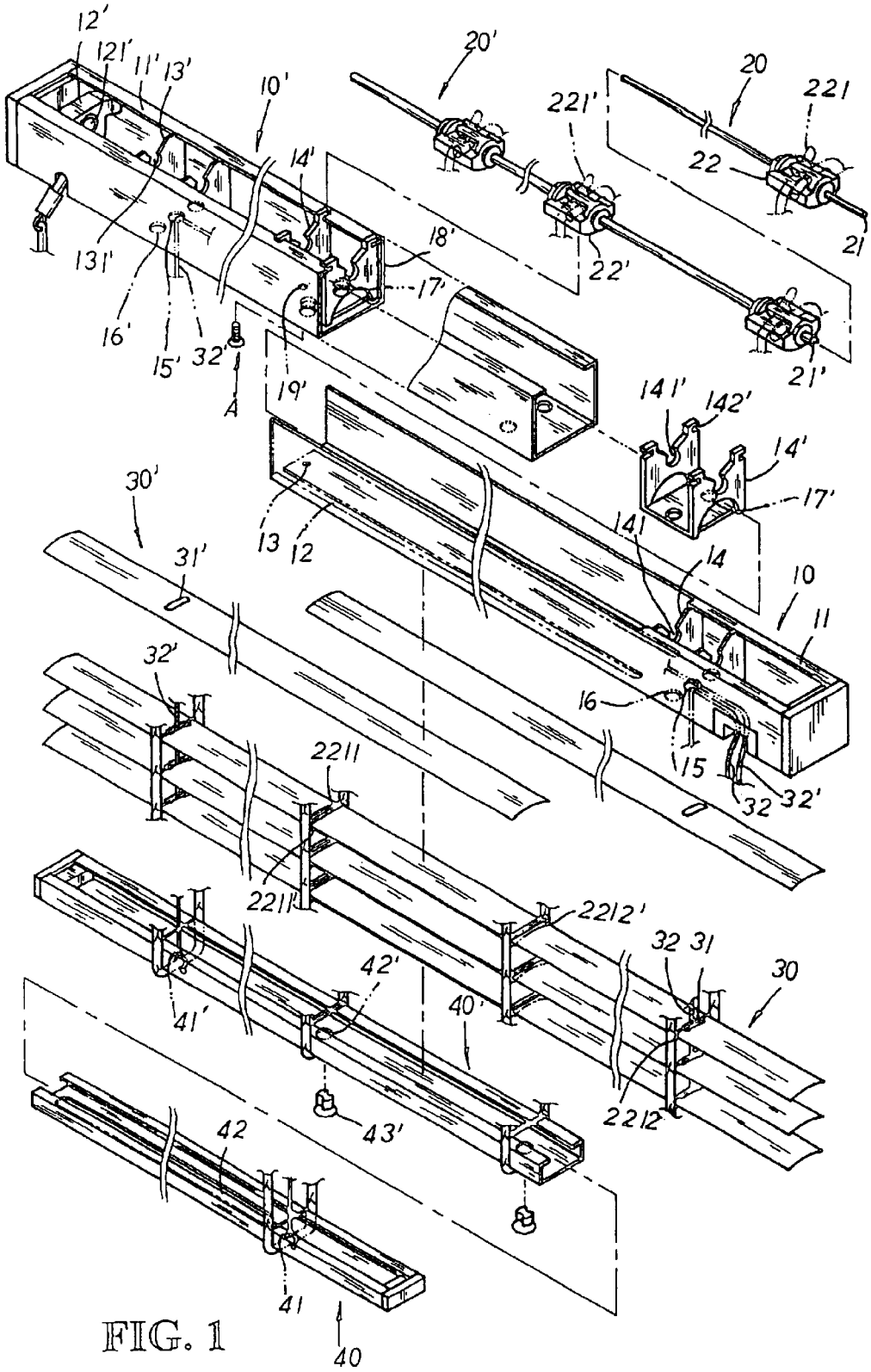
FIG. 1 is a perspective exploded view of the present invention.

Please refer to FIG. 1. The present invention is related to a Venetian blind structure, comprising an upper inner and outer brackets 10, 10', an internal and external rods 20, 20', multiple pairs of upper inner and lower outer blind slats 30, 30', and a lower inner and outer brackets 40, 40'. The upper inner bracket 10 is a U-shaped body, having a pair of stop flanges 11 symmetrically extending at the top of one side thereon, a pair of transverse elongated slots 12 symmetrically cut at the bottom of the other side thereon, and a screw hole 13 disposed at the bottom lateral edge of the other side thereof. A first pull cord mount 14 with a first pair of elastic cavities 141 symmetrically defined thereon is retained under the stop flanges 11 of the upper inner bracket 10 thereof, and a first pull cord hole 15 with a first pair of retaining cord holes 16 are correspondingly disposed at the bottom sides of the first pull cord mount 14 and the upper inner bracket 10 thereon respectively in mutual communication thereby. The upper outer bracket 10', a U-shaped body with an inner periphery larger than the outer periphery of the upper inner bracket 10 thereof, is equipped with a pair of stop plates 11' symmetrically extending at the top surface thereon, and a turbo-gear set 12' with a through hole 121' disposed thereon adapted to the interior at one side thereof. A second pull cord mount 13' having a second pair of elastic cavities 131' symmetrically cut thereon, and two retaining cord mounts 14' each having a pair of symmetric elastic grooves 141' defined thereon are equidistantly located in a sequence at the other side of the upper outer bracket 10' therein. A second pull cord hole 15' with a second pair of retaining cord holes 16' are correspondingly disposed at the bottom sides of the second pull cord mount 13' and the upper outer bracket 10' thereon respectively for mutual communication thereby, and a pair of retaining cord passages 17' is correspondingly disposed at the bottom sides of each retaining cord mount 14' and the upper outer bracket 10' thereon respectively.

Figure 3:
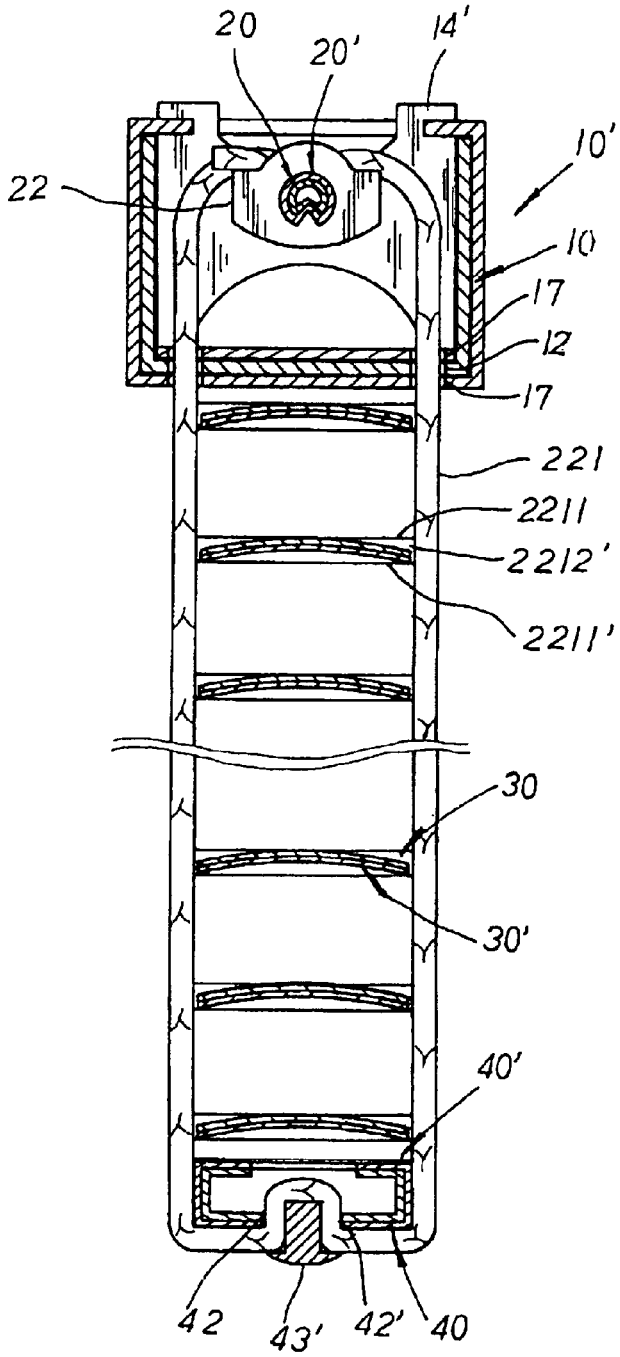
FIG. 3 is a cross sectional view of the present invention in assembly.

Each of the retaining cord mounts 14' also includes a pair of C-shaped insert grooves 142' symmetrically cut at both upper lateral sides thereon to be engaged with the stop plates 11' of the upper outer bracket 10 thereby to define a U-shaped preset space 18' at the inner periphery of the upper outer bracket 10' therein. And the upper outer bracket 10' also has a fixing hole 19' properly disposed at the bottom surface of one side thereon. The internal and external rods 20, 20', telescopically joined in sleeve engagement, are respectively provided with internal and external slant clamping legs 21, 21' properly cut at the bottom sides thereon to be mutually abutted thereby as shown in FIG. 3. An inner adjustment block 22 is disposed at one side of the internal rod 20 for holding both ends of an inner retaining cord 221 thereby, and three outer adjustment blocks 22' are equidistantly adapted to the external rod 20' thereon and sequentially matched to the second pull cord mount 13' and the two retaining cord mounts 14' of the upper outer bracket 10' respectively for holding three outer retaining cords 221' by both ends thereof. Each of the inner/outer retaining cords 221, 221' thereof, led into a U-shaped cord, has multiple pairs of upper and lower clamping sections 2211, 2211' equidistantly arranged from top to bottom thereof with a retaining hole 2212, 2212' formed between each pair of the upper and lower clamping section's 2211, 2211' thereof for each pair of the upper inner and lower outer blind slats 30, 30' to be adapted therein. At the corresponding outer side of the upper inner and lower outer blind slats 30, 30' are respectively disposed a right and left through holes 31, 31' for a right and left pull cords 32, 32' to be led there-through. The lower inner and outer brackets 40, 40', telescopically adjusted in sleeve engagement, are led through the interior of the U-shaped inner/outer retaining cords 221, 221' and retained at the bottom side therein. The lower inner bracket 40 has a first pull cord passage 41 disposed at one bottom side thereon, and a movement slot 42 transversely cut at the other side thereon. The lower outer bracket 40' is provided with a second pull cord passage 41' and two sleeve holes 42' equidistantly disposed in a sequence at the inner bottom side thereon wherein each sleeve hole 42' is matched to a locating sleeve 43'.

Figure 2:
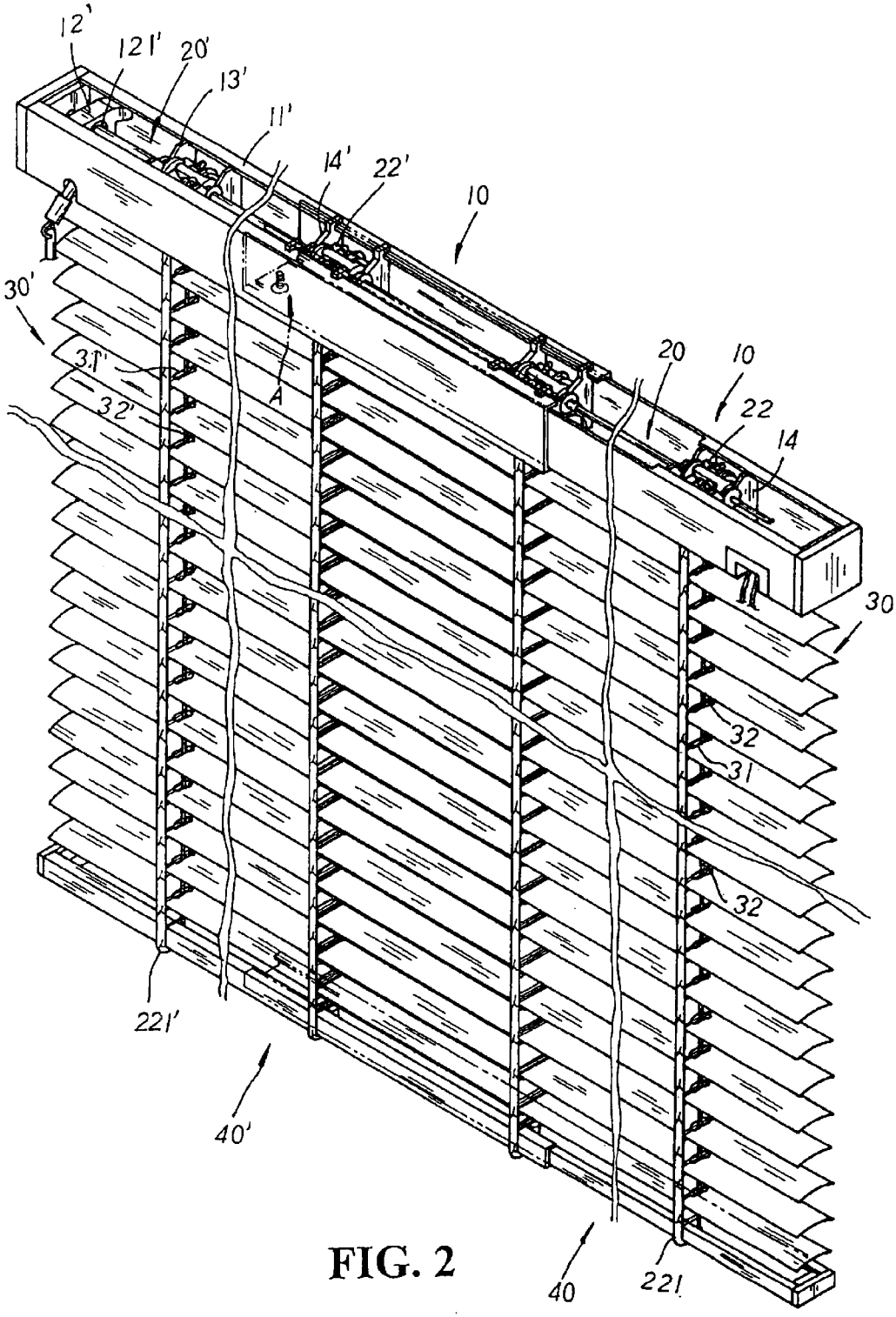
FIG. 2 is a perspective view of the present invention in assembly.

Please refer to FIGS. 2 to 3 inclusive. In assembly, the internal rod 20 is forced through in sleeve engagement with the first pair of elastic cavities 141 thereof and located onto the first pull cord mount 14 before both ends of the inner retaining cord 221 are led upwards through the first pair of retaining cord holes 16 of the upper inner bracket 10 respectively and securely fixed to the inner adjustment block 22 for location thereby. The external rod 20' is passed through the through hole 121' of the turbo-gear set 12' at one end thereof, and sequentially joined to the second pair of elastic cavities 131' of the second pull cord mount 13' and the elastic grooves 141' of the retaining cord mounts 14' thereof respectively at the other end before both ends of each outer retaining cords 221' thereof are correspondingly led upwards through the second pair of retaining cord holes 16' of the upper outer bracket 10' and fixedly attached to the outer adjustment blocks 22' thereof respectively. The upper inner bracket 10 is then guided through the U-shaped preset space 18' of the upper outer bracket 10' till the screw hole 13 thereof is correspondingly matched to the fixing hole 19' thereof and securely joined thereto via a screw A led from top to bottom and vice versa. Meanwhile, the internal rod 20 is joined to the external rod 20' thereof in sleeve engagement therewith with the internal and external slant clamping legs 21, 21' thereof mutually abutted in flexible clamping location thereby, and the two outer retaining cords 221' disposed at the middle section of the engaged upper inner/outer brackets 10, 10' thereof are limited at the transverse elongated slots 12 therein. Thus, the upper inner and outer brackets 10, 10' thereof are assembled into a telescopically adjusted upper beam with the inner and outer retaining cords 221, 221' thereof extending downwards at the underside thereon. Each pair of the mutually abutted upper inner and lower outer blind slats 30, 30' are then adapted to the retaining holes 2212, 2212' thereof and located therein via the upper and lower clamping sections 2211, 2211' thereof respectively. The right and left pull cords 32, 32' passed through the first/second pull cord holes 15, 15' thereof are led downwards from top to bottom through the right and left through holes 31, 31' of the upper inner and lower outer blind slats 30, 30' thereof respectively. The lower inner and outer brackets 40, 40' are then mutually engaged before located to the interior of the bottommost side of the U-shaped inner/outer retaining cords 221, 221' thereof to form a telescopically adjustable lower beam. The bottommost sides of the inner/outer retaining cords 221, 221' are correspondingly matched to the first/second pull cord passages 41, 41' and the sleeve holes 42' thereof respectively before the locating sleeves 43' thereof are forced through the sleeve holes 42' and extended upwards at the movement slot 42 therein to abut against the corresponding outer retaining cords 221' thereof in clamping location thereby. The bottom ends of the right and left pull cords 32, 32' are then passed through the first and second pull cord passages 41, 41' thereof respectively to be tied up to the bottommost side of the inner retaining cord 221 and the outer retaining cord 221' disposed at the outer side of the lower outer bracket 40' thereof to complete the assembly of the present invention.

Figure 4:
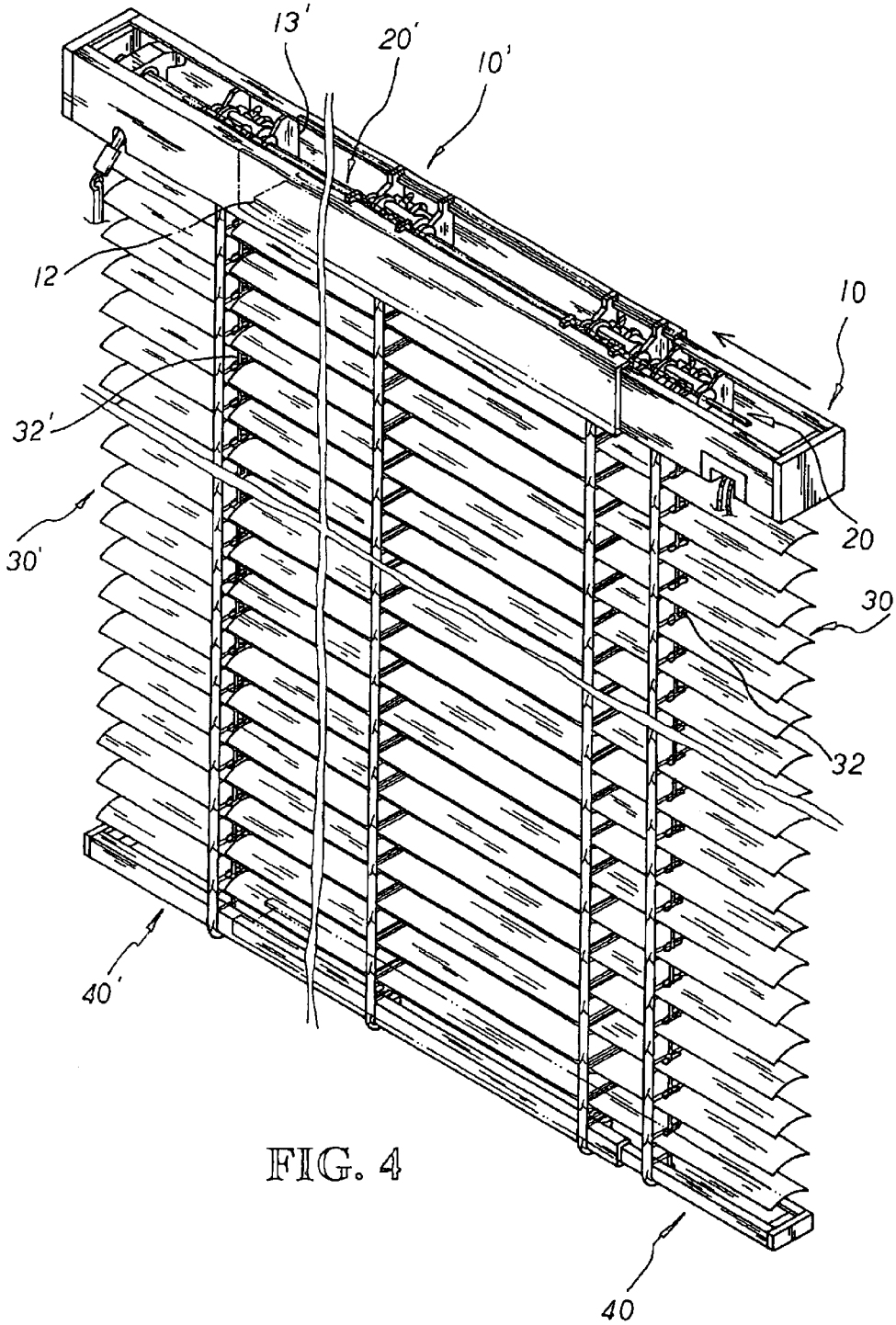
FIG. 4 is a diagram showing the present invention in gathering-up operation thereof.

Please refer to FIG. 4. The present invention is easily packed for delivery due to the sleeve engagement of the upper and lower inner/outer brackets 10, 10' 40, 40' and the abutting location of the upper inner and lower outer blind slats 30, 30' thereof. To gather up the present invention for delivery thereof, the screw A is dismounted from the screw hole 13 and the fixing hole 19' thereof for the upper inner bracket 10, the upper inner blind slats 30, and the lower inner bracket 40 to be pushed to one side simultaneously till the inner lateral side of the upper inner bracket 10 abutted against the second pull cord mount 13' of the upper outer bracket 10' thereof, and the upper inner blind slats 30 and lower inner bracket 40 moved along with the right pull cord 32 thereof. Meanwhile, the internal rod 20 is simultaneously joined at the external rod 20' therein in sleeve engagement therewith. Thus, the blind embodiment of the present invention can be flexibly adjusted shorter in overall length, efficiently cutting down the packing materials required and the shipping size occupied for more economical use of the shipment space so as to increase the quantity of shipment and the convenience of delivery thereof.

What is claimed is:

1. A blind structure comprising:

a) an upper outer bracket having:

i) a turbo-gear set located on a first end thereof;

ii) two retaining cord mounts located in the upper outer bracket, each of the two retaining cord mounts having a pair of elastic cavities;

iii) a second pull cord mount located in the upper outer bracket between the turbo-gear set and the two retaining cord mounts and having a pair of elastic cavities;

iv) a second pair of retaining cord holes;

v) a second pull cord hole located below the second pull cord mount and between the second pair of retaining cord holes; and vi) two pairs of retaining cord passages, one of the two pairs of retaining cord passages located below each of the two retaining cord mounts;

b) an upper inner bracket slidably inserted into a second end of the upper outer bracket and having:

i) a pair of transverse elongate slots located in a bottom thereof;

ii) a first pull cord mount located in the upper inner bracket and having a pair of elastic cavities;

iii) a first pair of retaining cord holes; and iv) a first pull cord hole located below the first pull cord mount and between the first pair of retaining cord holes;

c) an external rod having a first end connected to the turbo-gear set and having three outer adjustment blocks spaced apart thereon, one of the three outer adjustment blocks being rotatably inserted into the pair of elastic cavities of each of the two retaining cord mounts and the second pull cord mount;

d) an internal rod slidably inserted into a second end of the external rod and having an inner adjustment block rotatably inserted into the pair of elastic cavities of the first pull cord mount;

e) a plurality of outer blind slats, each of the plurality of outer blind slats having a left through hole;

f) a plurality of inner blind slats, each of the plurality of inner blind slats having a right though hole, one of the plurality of inner blind slats being slidably connected to each of the plurality of outer blind slats to form a blind set;

g) a lower outer bracket having a second pull cord passage;

h) a lower inner bracket slidable inserted into the lower outer bracket and having a first pull cord passage;

i) three outer retaining cords, each of the three outer retaining cords having two opposing ends connected to one of the three outer adjustment blocks and a plurality of clamping sections forming a plurality of retaining holes there between;

j) an inner retaining cord having two opposing ends connected to the inner adjustment block and a plurality of clamping sections forming a plurality of retaining holes there between, one blind set being inserted through a selected retaining hole of each of the three outer retaining cords and the inner retaining cord;

k) a left pull cord inserted through the second pull cord hole, each left through hole of the plurality of outer blind slats and the second pull cord passage, and having an end fixed below the lower outer bracket; and l) a right pull cord inserted through the first pull cord hole, each right through hole of the plurality of outer blind slats and the first pull cord passage, and having an end fixed below the lower inner bracket.

2. The blind structure according to claim 1, wherein the upper outer bracket having a pair of stop plates, and the upper inner bracket having a pair of stop flanges.

3. The blind structure according to claim 2, wherein each of the two retaining cord mounts having insert grooves located on opposing sides thereof, one of the pair of stop flanges and one of the pair of stop plates are slidably inserted into each of the insert grooves.

4. The blind structure according to claim 1, wherein each of two inner most retaining cords of the three outer retaining cords are located in the pair of transverse elongate slots.

5. The blind structure according to claim 1, further comprising a screw, the upper outer bracket has a fixing hole, the upper inner bracket has a screw hole, the screw being removably connected to the screw hole, wherein, when the screw is inserted through the fixing hole and connected to the screw hole, the upper outer bracket and the upper inner bracket are fixedly connected for shipping.

6. The blind structure according to claim 1, wherein the external rod having external slant clamping legs, the internal rod having internal slant clamping legs aligning with the external slant clamping legs.

* * * * *